United States Patent [19]

Marlor

[11] 4,288,713

[45] Sep. 8, 1981

[54] LAMP HAVING OPAQUE COATING

[75] Inventor: Richard C. Marlor, Beverly, Mass.

[73] Assignee: GTE Products Corporation, Stamford, Conn.

[21] Appl. No.: 97,008

[22] Filed: Nov. 23, 1979

[51] Int. Cl.[3] ..... H01K 1/32

[52] U.S. Cl. ..... 313/117; 427/106; 313/221; 501/21; 501/53; 501/141

[58] Field of Search ..... 313/117, 221, 113; 427/106; 106/312 (U.S. only), 48 (U.S. only)

[56] References Cited

U.S. PATENT DOCUMENTS

| | | | |
|---|---|---|---|
| 1,691,832 | 11/1928 | Sweet | 313/117 |
| 2,840,490 | 6/1958 | Collins et al. | 106/48 X |
| 2,946,697 | 7/1960 | Petro | 427/106 |
| 3,108,885 | 10/1963 | Dunseth | 106/48 |
| 3,784,861 | 1/1974 | Notelteirs et al. | 313/117 |

*Primary Examiner*—Palmer C. Demeo

*Attorney, Agent, or Firm*—James Theodosopoulos

[57] ABSTRACT

An incandescent lamp has on a portion of the lamp envelope a dark coating comprising manganese dioxide and aluminum phosphate.

6 Claims, 1 Drawing Figure

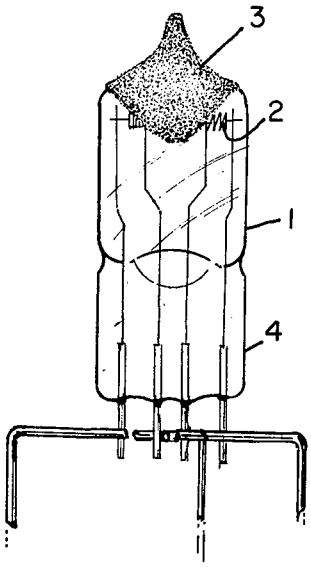
3
2
1
4

LAMP HAVING OPAQUE COATING

DESCRIPTION

1. Technical Field

This invention is concerned with electric incandescent lamps. Such lamps have a glass envelope and a tungsten filament. The invention is particularly concerned with the use of an opaque coating on the glass envelope.

2. Background Art

Opaque coatings are often used on a portion of lamp envelopes to prevent transmission of light through said portion. An example of such a coating is shown in U.S. Pat. No. 3,784,861. There, the lamp is used in an automobile headlight, and the opaque coating serves as a screen to block some of the visible light radiated by the lamp filaments. Said opaque coating is formulated for use on quartz envelopes and comprises a mixture of silicon, kaolin and ethyl silicate, the latter being converted to silicon dioxide upon heating of the coating at 250° to 500° C. Other prior art opaque coatings have used lead, which can be a toxic material.

DISCLOSURE OF INVENTION

This invention discloses an opaque coating for incandescent lamps that is lead-free and which can be cured at room temperature. The coating is easier to process than that in U.S. Pat. No. 3,784,861. The coating comprises manganese dioxide as the dark material and aluminum phosphate as a low temperature bonding agent. The coating can be applied from a liquid suspension additionally containing kaolin clay and boric acid, the liquid medium being water.

BRIEF DESCRIPTION OF DRAWING

The drawing shows a coated lamp envelope in accordance with this invention.

BEST MODE FOR CARRYING OUT THE INVENTION

As shown in the drawing the lamp comprises a glass envelope 1 having at least one tungsten filament 2 therein. Disposed on a portion of envelope 1 is an opaque coating 3 bonded to glass envelope 1. Opaque coating 3 comprises a mixture of manganese dioxide and aluminum phosphate.

In one embodiment, such as shown in copending application Ser. No. 960,375, filed Nov. 13, 1978, and now abandoned, the lamp comprised a hard glass halogen capsule for an automobile headlight. Envelope 1 was made of low expansion ($42\times10^{-7}$ in/in/° C.) hard glass and was filled with a typical halogen-containing atmosphere. Coating 3 was disposed on the end of envelope 1 opposite press seal 4.

In accordance with this invention, coating 3 comprised a mixture of manganese dioxide, aluminum phosphate, kaolin clay and boric acid, and was applied by dipping the end of envelope 1 into an aqueous suspension of the four ingredients. In a specific example, the suspension was made up of (by weight): 31.5% powdered manganese dioxide (less than 325 mesh); 9.5% powdered kaolin clay (less than 325 mesh); 4.0% boric acid powder; 27.5% aluminum phosphate in a phosphoric acid solution (e.g., Aremco Cerama-Bind 542); and 27.5% water. A small quantity (0.05%) of a wetting agent, for example, Pluronic L61, was added to the batch to enhance wetting of the dipping suspension to the glass envelope. The dipping suspension was prepared by mixing the batch components in a ball mill for 15 hours. The functions of the ingredients are as follows. Manganese dioxide is a black pigment which can be suspended in a liquid medium by the addition of a sufficient amount of Clay. Boric acid will melt at 236° C. to form a glass which increases the adhesion characteristics of the black coating at the operating temperatures of the lamp. Aluminum phosphate is the primary binding material which will form an aluminum phosphate matrix upon curing. This matrix is responsible for the low temperature strength of the black coating. During the long operating life of the lamp, the aluminum phosphate cementing matrix does not degrade and will adhere tightly to the hard glass lamp envelope. The small addition of boric acid increases the high temperature strength of the black coating. The coating is sufficiently refractory and free from high expansion phases to withstand normal lamp operating temperatures which can be as high as 700° C. In addition the coating is sufficiently inert to alkali diffusion to prevent interdiffusion and subsequent crazing of the lamp envelope.

Although coating 3 will cure in a short time after it has been applied to envelope 1, the curing can be accelerated by a moderately elevated temperature, say, two minutes at 50° C.

I claim:

1. In an incandescent lamp including at least one tungsten filament disposed within a glass envelope, the improvement comprising an opaque coating on a portion of the envelope for preventing transmission of light therethrough, the coating comprising a dark mixture of manganese dioxide and aluminum phosphate.

2. The lamp of claim 1 wherein said mixture includes kaolin clay.

3. The lamp of claim 1 wherein said mixture includes boric acid.

4. The lamp of claim 1 wherein said dark mixture additionally includes kaolin clay and boric acid.

5. The lamp of claim 1 wherein said opaque coating is applied by dipping said envelope portion into an aqueous suspension containing said dark mixture.

6. The lamp of claim 5 wherein said aqueous suspension contains, in addition, kaolin clay and boric acid.

* * * * *